US009468309B2

(12) United States Patent
Grubbs et al.

(10) Patent No.: US 9,468,309 B2
(45) Date of Patent: Oct. 18, 2016

(54) TRACKLESS PUSHER FOR LARGE ITEMS

(71) Applicants: Matthew Grubbs, Union, KY (US); Shane Obitts, Elyria, OH (US)

(72) Inventors: Matthew Grubbs, Union, KY (US); Shane Obitts, Elyria, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 50 days.

(21) Appl. No.: 14/444,627

(22) Filed: Jul. 28, 2014

(65) Prior Publication Data

US 2015/0041418 A1 Feb. 12, 2015

Related U.S. Application Data

(60) Provisional application No. 61/864,966, filed on Aug. 12, 2013.

(51) Int. Cl.
*A47F 1/12* (2006.01)
*A47F 5/00* (2006.01)

(52) U.S. Cl.
CPC ..... *A47F 1/126* (2013.01); *A47F 5/005* (2013.01)

(58) Field of Classification Search
CPC ..... A47F 1/12; A47F 1/125; A47F 1/126
See application file for complete search history.

(56) References Cited

U.S. PATENT DOCUMENTS 2,079,754 A * 5/1937 Waxgiser ..... A47F 1/125 211/59.3
3,751,129 A * 8/1973 Wright ..... B42F 17/02 211/51
3,814,490 A * 6/1974 Dean ..... B42F 17/02 211/51
4,378,872 A * 4/1983 Brown ..... B65G 1/06 198/570
4,809,856 A * 3/1989 Muth ..... A47B 57/586 108/60
4,830,201 A * 5/1989 Breslow ..... A47F 5/005 211/184
5,613,621 A * 3/1997 Gervasi ..... A47F 1/125 221/279
6,129,218 A * 10/2000 Henry ..... A47F 5/005 211/59.3
6,409,028 B2 * 6/2002 Nickerson ..... 108/61
6,523,703 B1 * 2/2003 Robertson ..... A47F 1/126 211/51
6,655,536 B2 * 12/2003 Jo ..... A47F 1/126 211/184
7,152,536 B2 * 12/2006 Hardy ..... A47F 1/126 108/61
7,195,123 B2 3/2007 Roslof et al.
7,823,734 B2 11/2010 Hardy
7,913,861 B2 * 3/2011 Mueller ..... A47F 1/126 211/59.3
7,922,010 B2 * 4/2011 Hardy ..... A47F 1/126 211/151
7,926,668 B2 4/2011 Barkdoll
8,069,994 B2 * 12/2011 Barkdoll ..... A47F 1/126 211/119.003
8,127,944 B2 3/2012 Hardy (Continued)

FOREIGN PATENT DOCUMENTS

DE 4211569 A1 * 10/1993 ..... A47F 1/125
FR 2667229 A1 * 4/1992 ..... A47F 1/126

(Continued)

*Primary Examiner* — Stanton L Krycinski
(74) *Attorney, Agent, or Firm* — Fay Sharpe LLP

(57) ABSTRACT

A trackless pusher system for a shelf defining a top surface includes a pusher having a base that is supported by the shelf top surface. A coiled spring includes a first end that is mounted to the shelf and a second end which is supported on the pusher base. A divider is mounted to the shelf, wherein the divider includes a base wall which is spaced from the shelf top surface so as to define a slot therebetween. An adjustable protrusion is mounted to the pusher for lateral extension in relation to the base of the pusher, wherein the arm extends into the slot and rides in the slot as the pusher moves forwardly and rearwardly on the shelf such that the pusher body is stabilized by the divider.

20 Claims, 14 Drawing Sheets

(56) References Cited

U.S. PATENT DOCUMENTS

| | | | | |
|---|---|---|---|---|
| 8,172,094 | B2 * | 5/2012 | Meyer | A47F 1/126 211/134 |
| 8,276,766 | B2 * | 10/2012 | Rataiczak, III | A47F 1/126 211/184 |
| 8,312,999 | B2 | 11/2012 | Hardy | |
| 8,322,544 | B2 | 12/2012 | Hardy | |
| 8,328,027 | B2 | 12/2012 | Barkdoll | |
| 8,469,205 | B1 | 6/2013 | Hardy | |
| 8,627,965 | B2 * | 1/2014 | Hardy | A47F 1/126 211/184 |
| 8,739,984 | B2 | 6/2014 | Hardy | |
| D719,194 | S * | 12/2014 | Lee | D15/89 |
| 8,910,802 | B2 * | 12/2014 | Hardy | A47F 1/126 211/184 |
| 2005/0166806 | A1 * | 8/2005 | Hardy | A47F 1/126 108/61 |
| 2007/0108142 | A1 | 5/2007 | Medcalf et al. | |
| 2008/0142458 | A1 * | 6/2008 | Medcalf | A47F 1/126 211/59.3 |
| 2013/0200019 | A1 | 8/2013 | Hardy et al. | |
| 2014/0138330 | A1 | 5/2014 | Hardy | |
| 2014/0151313 | A1 | 6/2014 | Breslow et al. | |

FOREIGN PATENT DOCUMENTS

| | | | | |
|---|---|---|---|---|
| FR | WO 03084371 | A1 * | 10/2003 | A47F 1/126 |
| FR | 2942590 | A1 * | 9/2010 | A47F 1/126 |

* cited by examiner

TRACKLESS PUSHER FOR LARGE ITEMS

CROSS REFERENCE TO RELATED PATENTS AND APPLICATIONS

This application claims priority to and the benefit of the filing date of U.S. Provisional Patent Application Ser. No. 61/864,966, filed Aug. 12, 2013, which application is hereby incorporated by reference.

BACKGROUND

This disclosure relates generally to merchandising assemblies, such as may be used for large items. The disclosure relates more particularly to a shelf assembly having an improved mechanism for displaying and pushing product forward on a shelf.

In self-service retail establishments, such as drug stores, grocery stores and the like, articles are usually displayed for sale on racks consisting of vertically spaced shelves on which the articles are arranged in rows. In displaying product, it is desirable for the product to be situated towards the front of the shelf so that the product is visible and accessible to consumers, particularly if the shelf is not at eye level. To accomplish this placement, known systems may include inclined trays or shelves which through gravity will cause the product to move forward towards the front of the shelf. Other systems include the use of pusher devices to urge the product towards the front of the shelf. Such pusher devices can be used on both gravity fed shelves and horizontal shelves. The known pusher systems are typically mounted to a track and include a pusher paddle and a coiled spring to urge the product forward on the shelf. However, as the system is used over time, the track may become obstructed with dirt or sticky materials which hinder the proper operation of the pusher system in the track. In addition, depending on the size, shape and weight of the product which is to be merchandised, the known pusher paddles may occasionally tip or bend backwards, thereby causing a binding of the pusher mechanism in the track. In those situations, the pusher mechanism may not properly push product toward the front of the shelf.

As a result, some have provided trackless pusher systems which can work with either gravity fed merchandising systems or non-gravity fed merchandising systems to urge product forward on a shelf. However, the known trackless pusher systems also have disadvantages, particularly when they are employed for urging larger merchandise forward on a shelf. As mentioned, the size, shape and/or weight of the merchandise may cause the known pusher paddles to twist in relation to the axis of a column of product and, thus, fail at their function of urging merchandise forward on the shelf. Also, without the track, and with the pusher not operating correctly, the merchandise may be able to bend or bow outwardly any divider walls employed in the merchandising system. This results in the merchandise not being held in a tight columnar arrangement on the shelf. In addition, without the track, the pusher may slip off the back of the rear item and, therefore, the merchandise is not urged forwardly or "faced" as expected.

There exists, therefore, a need in the art for a pusher system which addresses one or more of the above noted disadvantages of the known trackless pusher systems.

BRIEF SUMMARY

According to one embodiment, a trackless pusher system for advancing product supported on an associated shelf comprises at least one divider mountable to the associated shelf, the at least one divider delimiting one side of a pathway for associated product supported on the associated shelf, and a trackless pusher assembly for advancing the associated product along the pathway, the trackless pusher assembly comprising a pusher body, a securement member securable to a leading portion of the associated shelf, and a spring extending between and connecting the pusher body to the securement member, an adjustable first protrusion extending laterally away from the pusher body, the protrusion being slideably received in a slot at least partially defined by the at least one divider, the slot having a longitudinal axis extending in a common direction with the pathway. The pusher body is stabilized by the divider as the pusher body advances along the pathway.

The first protrusion can comprise an elongated arm. The elongated arm can be movable in relation to the pusher body, and adjusting a position of the arm relative to the pusher body changes a lateral extent of the arm. The system can further include a lock mechanism for locking the elongated arm in a selected one of a plurality of angular positions in relation to the pusher body. The lock mechanism can include a gear shaped protrusion associated with the arm, the gear shaped protrusion being adapted to cooperate with a fixed ribbed socket defined in the pusher body, the gear shaped protrusion being telescopically insertable in the ribbed socket in a plurality of orientations corresponding to different angular positions of the arm, whereby the gear shaped protrusion is movable axially between a locked position at which it is telescopically received within the ribbed socket to an unlocked position at which it is axially spaced from the ribbed socket and is allowed to rotate. A spring can bias the gear shaped protrusion into the locked position. The arm can further comprise a projection, the projection being mounted in a slot in the pusher body, whereby the lateral extent of the adjustable arm can be adjusted by sliding the projection within the slot in the pusher body. The projection of the arm can include an elongated portion to restrict rotation of the arm in relation to the pusher body. A second protrusion can be provided wherein the first and second protrusions extend laterally from opposed side edges of the pusher body. The at least one divider can comprise two spaced dividers between which the trackless pusher assembly is located such that the first and second protrusions cooperate with a respective one of the two spaced dividers.

In accordance with another aspect, a trackless pusher assembly for advancing product along a pathway of an associated shelf comprises a pusher body having a width, a securement member securable to a leading portion of the associated shelf, a spring extending between and connecting the pusher body to the securement member, at least one adjustable protrusion extending laterally from the pusher body and adapted to be received in a slot of an associated divider, the at least one adjustable protrusion being adapted to extend beyond the width of the pusher body a desired distance such that the pusher body can be positioned a variable distance from the associated divider so as to maintain a distal end of the at least one protrusion in the slot.

At least one protrusion can comprise an arm. The arm can be rotatably secured to the pusher body, and adjusting a rotational position of the arm relative to the pusher body changes a lateral extent of the arm. The assembly can further comprise an angular lock mechanism for locking the arm in a desired one of a plurality of angular positions. The angular lock mechanism can include a gear shaped protrusion associated with the arm and adapted to cooperate with a fixed ribbed socket defined in the pusher body, the gear shaped protrusion being telescopically insertable in the ribbed socket in a plurality of positions corresponding to different angular positions of the arm, whereby the gear shaped protrusion is movable axially between a rotationally interlocked position at which it is telescopically received within the ribbed socket to a rotatable position at which it is axially spaced from the ribbed socket. A spring can bias the gear shaped protrusion towards the first position. The arm can further comprise a projection, the projection being mounted in a slot in the pusher body, whereby the lateral extent of the arm can be adjusted by sliding the projection within the slot in the pusher body. The projection of the arm can include an elongated portion which cooperates with the slot to restrict rotation of the arm in relation to the pusher body. The protrusion can further include a grasping element extending away from the elongated portion. The trackless pusher wherein the at least one adjustable protrusion comprises two protrusions extending laterally from opposed side edges of the pusher body.

BRIEF DESCRIPTION OF THE DRAWINGS

The present invention may take physical form in certain parts and arrangements of parts, several embodiments of which will be described in detail in this specification and illustrated in the accompanying drawings which form a part hereof and wherein.

DETAILED DESCRIPTION

Figure 1:
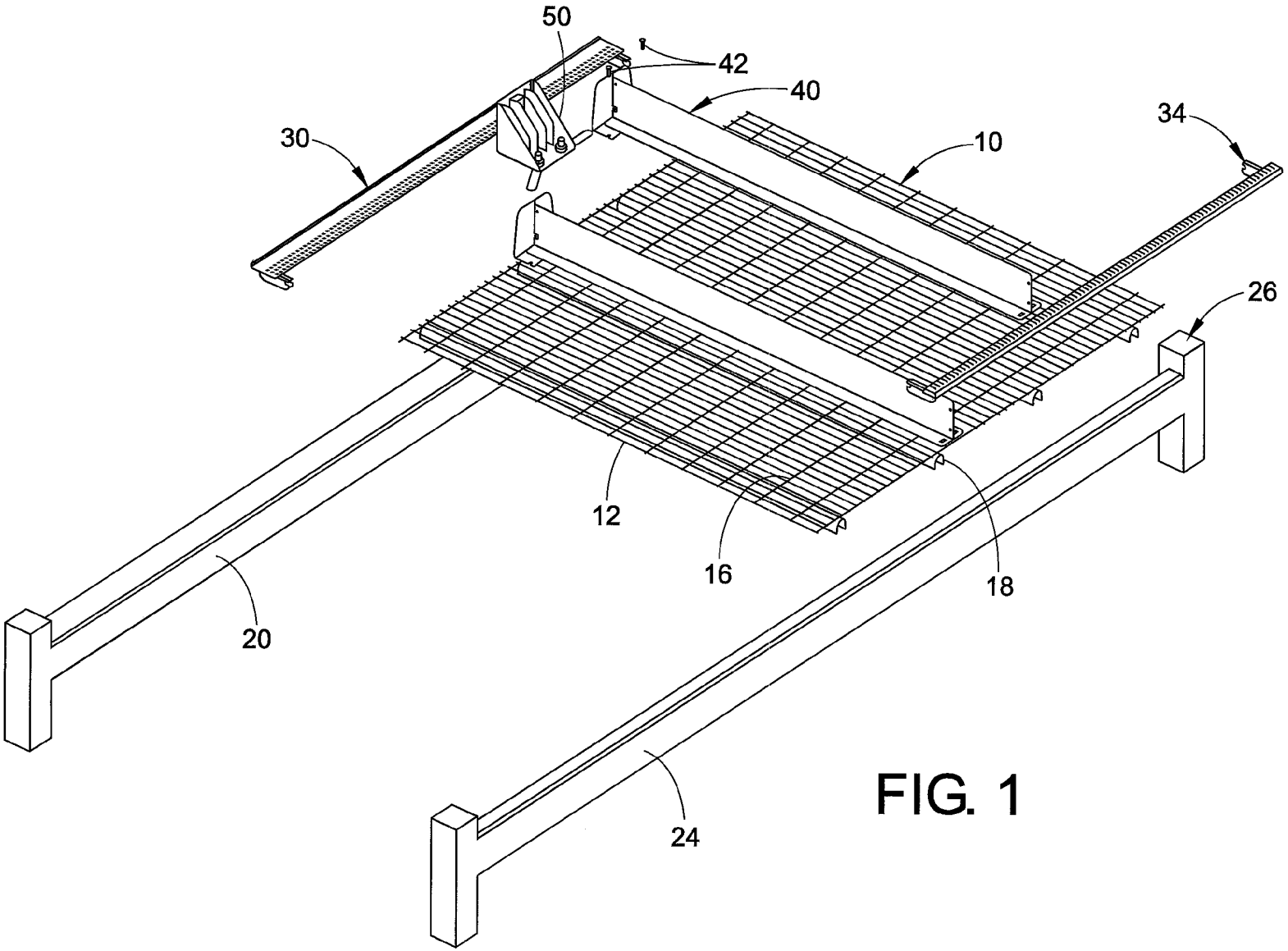
FIG. 1 is an exploded perspective view of a merchandising assembly according to a first embodiment of the present disclosure.

Referring now to the drawings wherein the showings are for purposes of illustrating several embodiments of the present disclosure and not for purposes of limiting same, FIG. 1 shows a merchandising system including a shelf 10. In this embodiment, the shelf is comprised of a series of spaced first rods 12 extending longitudinally front to back and a series of spaced second rods 16 extending laterally side to side, transverse to the orientation of the first rods, with the rods being connected to each other so as to form wire shelf. Support ribs 18 may be provided beneath the set of rods to stiffen the shelf 10. The shelf 10 is mounted on a front support 20 and a rear support 24 of a shelf frame 26.

Figure 2:
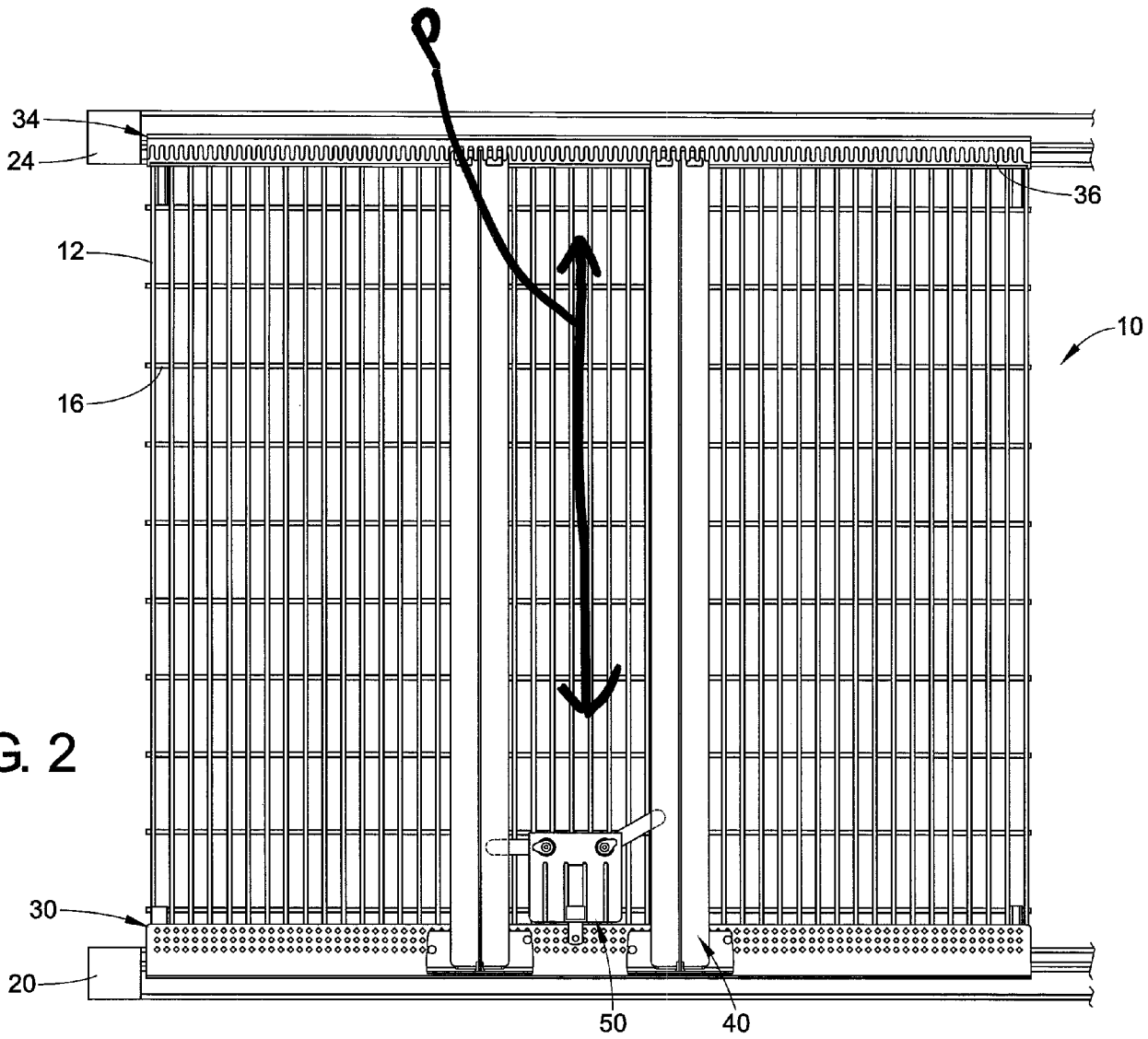
FIG. 2 is an enlarged top plan view of the merchandising system of FIG. 1.
Figure 3:
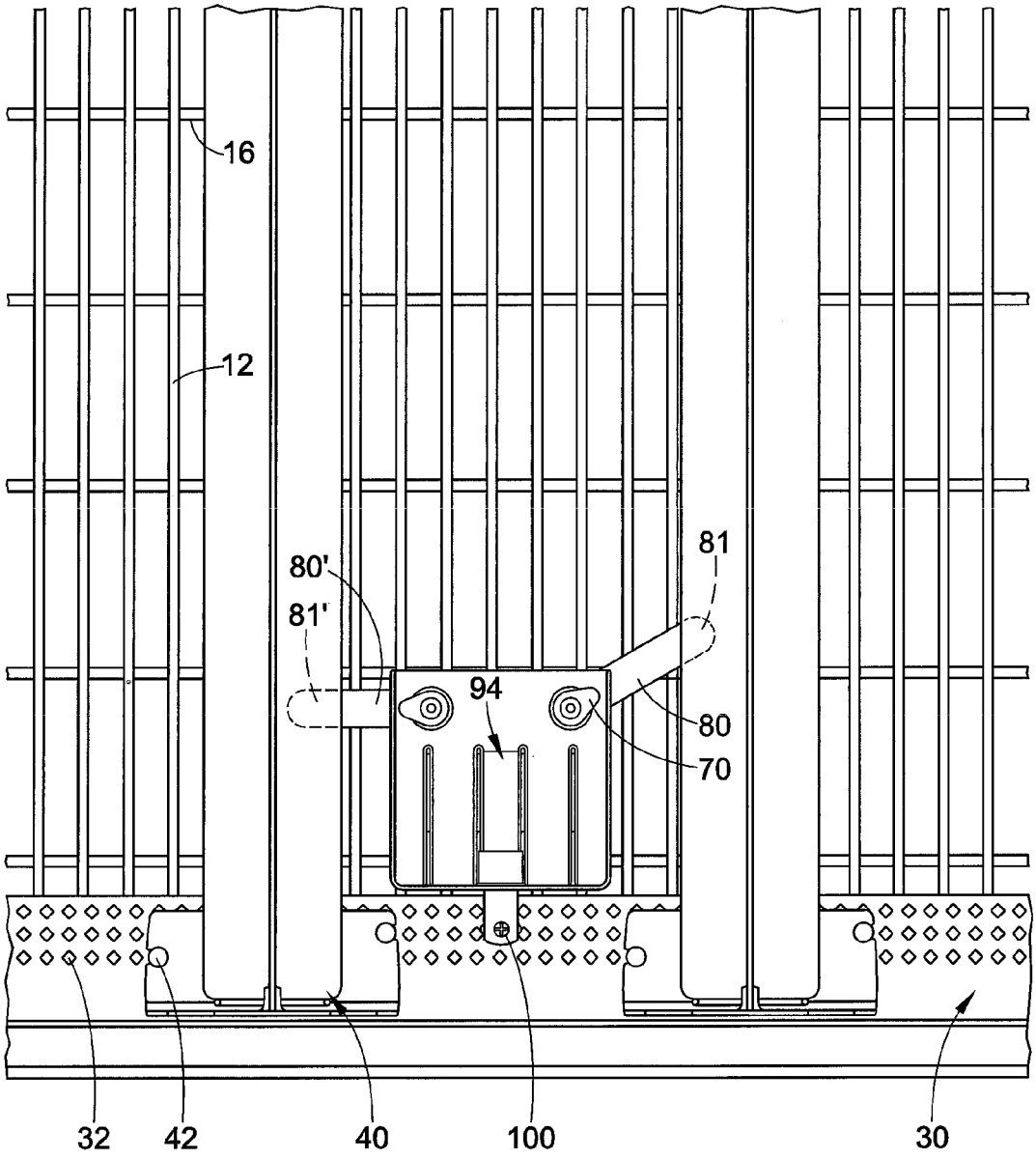
FIG. 3 is an enlarged top plan view of a portion of the merchandising system of FIG. 2.

With reference now also to FIG. 2, mounted to the front of the shelf 10 is a front grid 30 which comprises a plurality of apertures 32. The apertures may be diamond shaped, as best shown in FIG. 3. With reference again to FIG. 2, mounted to the rear end of the shelf 10 is a rear mount 34 which can comprise a plurality of teeth 36. Supported on the shelf and connected to the front grid 30 and the rear mount 34 is a divider assembly 40. Suitable pins, such as push pins 42, can be employed to mount the divider assembly to the front of the shelf, as shown in FIG. 3. The divider assembly 40 delimits one side of a product pathway P.

Figure 6:
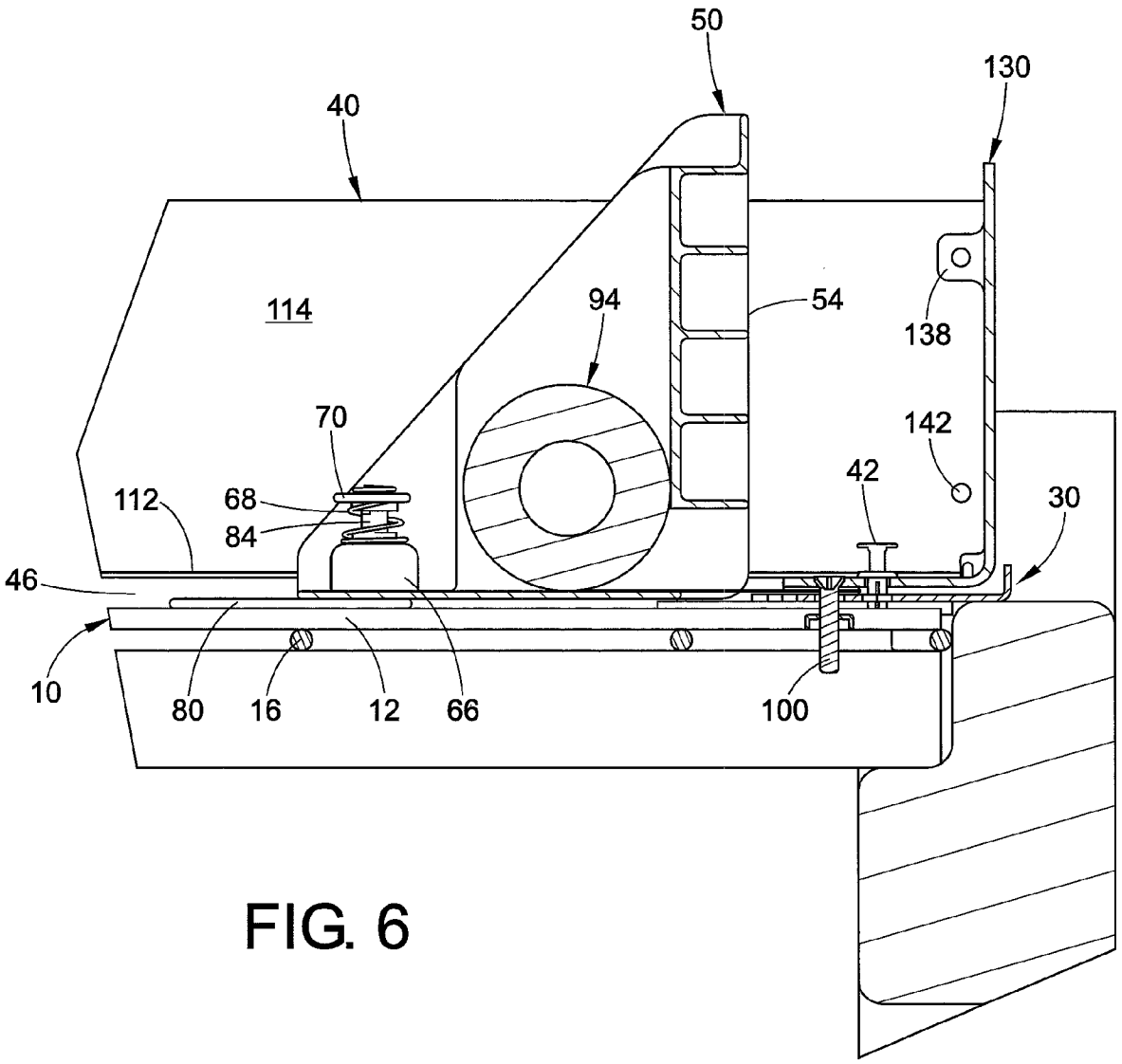
FIG. 6 is an enlarged cross sectional view of a portion of the merchandising system of FIG. 3.

As best seen in FIG. 6, the divider assembly 40 is spaced above the top surface of the shelf 10 so as to define a slot or gap 46 between them. The divider assembly 40 rests on the front grid 30 and rear mount 34 and is thus inherently spaced above the top surface of the shelf by the thickness of the grid and mount. This feature will be discussed in greater detail below.

Figure 4:
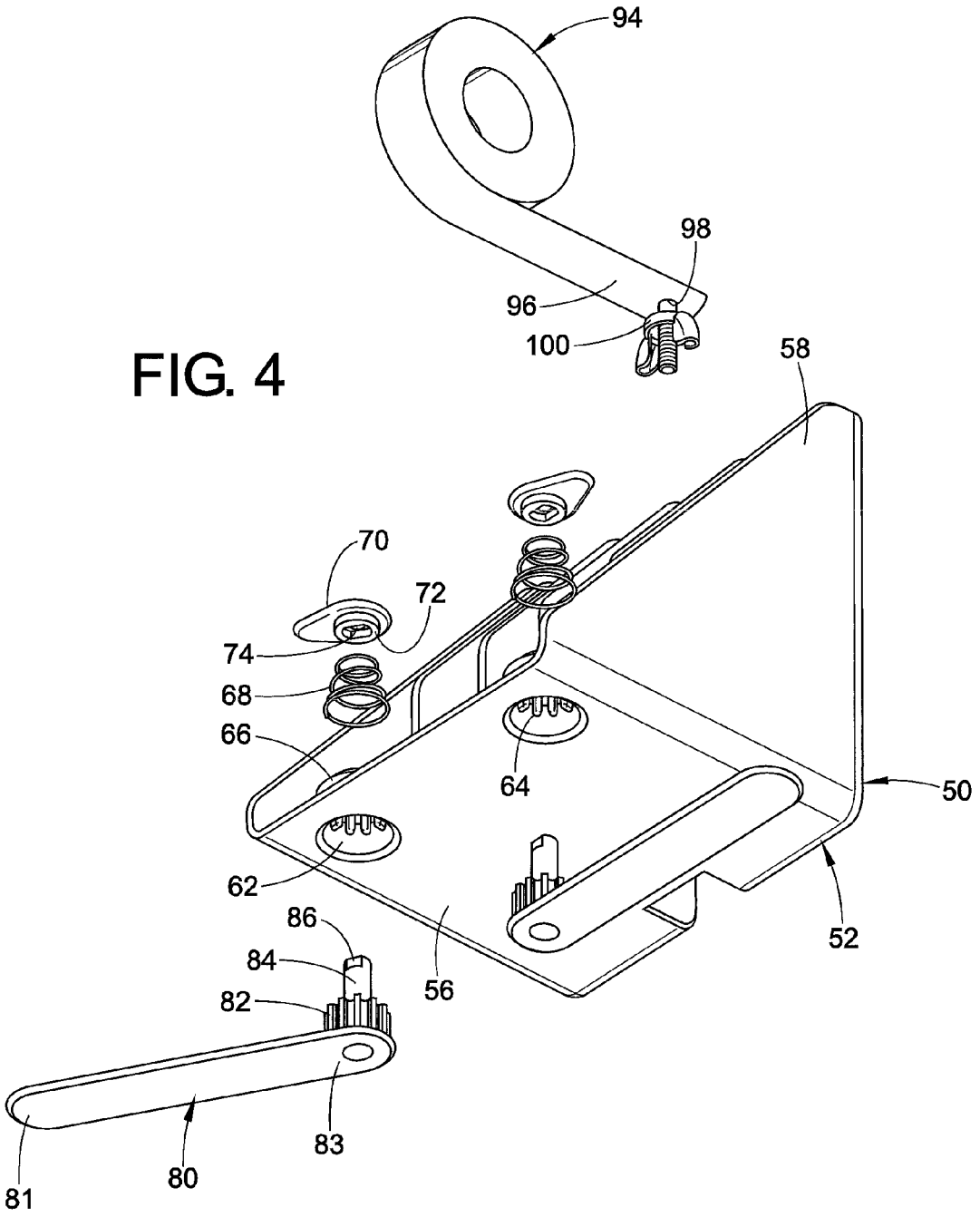
FIG. 4 is an exploded perspective view of a pusher employed in the merchandising system of FIG. 1.
Figure 5:
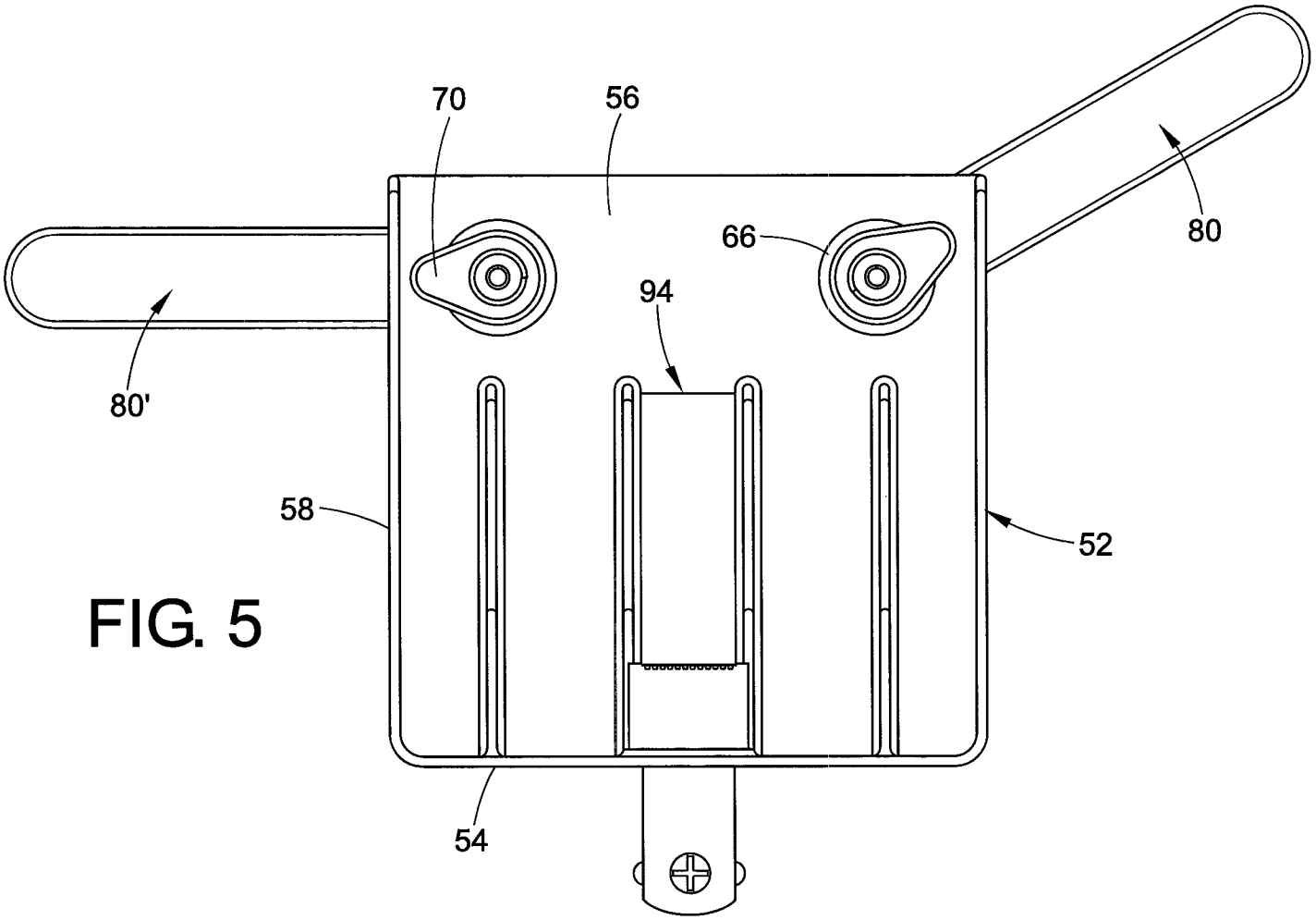
FIG. 5 is a top plan view of the pusher of FIG. 4 in an assembled condition.

Further provided in the merchandising assembly is a pusher 50. With reference now to FIG. 4, the pusher 50 comprises a body 52 which includes a pusher face 54 (see FIG. 5) and a base 56 extending rearwardly from the pusher face. As shown in FIG. 4, the pusher can be somewhat wedge shaped or triangular in side view. One or more gussets 58 extend between the pusher face 54 and the base 56 in order to stiffen the pusher body 52. Defined in the pusher base 56 are a pair of pockets 62 which each include a set of spaced ribs 64. The pockets are formed in a stand or housing 66 which extends upwardly from the plane of the base 56, as best seen in FIG. 6. Mounted atop the stand 66 is a spring 68. The spring resiliently biases a pivot member 70.

With reference again to FIG. 4, the pivot member includes a downwardly extending protrusion 72 which defines a socket 74. Configured to be mounted in the pocket 62 and to connect with the pivot member 70 is an arm 80. Two such arms 80 and 80' are shown. Since the two arms can be identical, only the first arm 80 is discussed in detail herein, it being appreciated that the second arm can include the same features. The arm includes a first end 81 and a gear shaped protrusion 82 is defined on an arm second end 83. Extending upwardly from the gear shaped protrusion 82 is an axle 84 which terminates in a shaped end portion 86 that is configured to fit in the socket 74 of the pivot member 70. The spring 68 urges the arm 80 into the pocket 62 so as to lock the arm 80 into a particular angular orientation in relation to the pusher 50. This is accomplished by the ribs 64 engaging in valleys between the protrusions 72, much like gear teeth engage each other, so that a pivoting movement of the arm 80 is prohibited.

However, upon pushing down the pivot member 80 thereby overcoming the biasing force of the spring 68, the protrusions 72 are pushed beneath the ribs 64 so as to enable a rotation of the arm 80 in relation to the pusher 50. In this way, the arm can be rotated as may be desired or necessary in order to accommodate the arm in the slot or gap 46 as can be best see in FIG. 3 of the drawings. In other words, the arm can be pivoted into a variety of angular orientations in relation to a longitudinal axis of the pusher 50 to accommodate the width of the merchandise which is stacked on the shelf 10, as well as the spacing of the divider assemblies 40. As is evident, the orientations include a transverse to the pusher axis and a variety of acute angles.

Urging the pusher forward on the shelf 10 is a spring 94. With reference now to FIG. 4, the spring includes a first end 96 in which is defined an aperture 98 which accommodates a conventional fastener 100. With reference again to FIG. 3, the fastener 100 can extend through one of the apertures 32 in the front grid so as to secure the spring 94 to the front grid. It is noted that no track is provided in this embodiment. Rather, the pusher operates without a track and is only secured to the shelf 10 via the spring 94. However, the two arms 80 and 80' as they ride in the slot 46 defined between the divider assembly 40 and the top surface of the shelf 10 to retard the pusher from pivoting or twisting in such a way as to inhibit the urging of a column of merchandise forwardly on the shelf by the pusher.

As noted, the pusher 50 extends across a width of the product pathway P and urges product forward along the product pathway P toward the front of the shelf. It should be appreciated that because the divider assemblies 40 can be placed at various positions to create product pathways having a variety of different widths, the adjustable arms of the pusher can be adjusted inwardly/outwardly to engage with the slots of the dividers. In some configurations, it may be desirable to have the pusher offset between respective divider assemblies. In such case, one adjustable arm can be configured to extend further than the other.

Figures 7, 8:
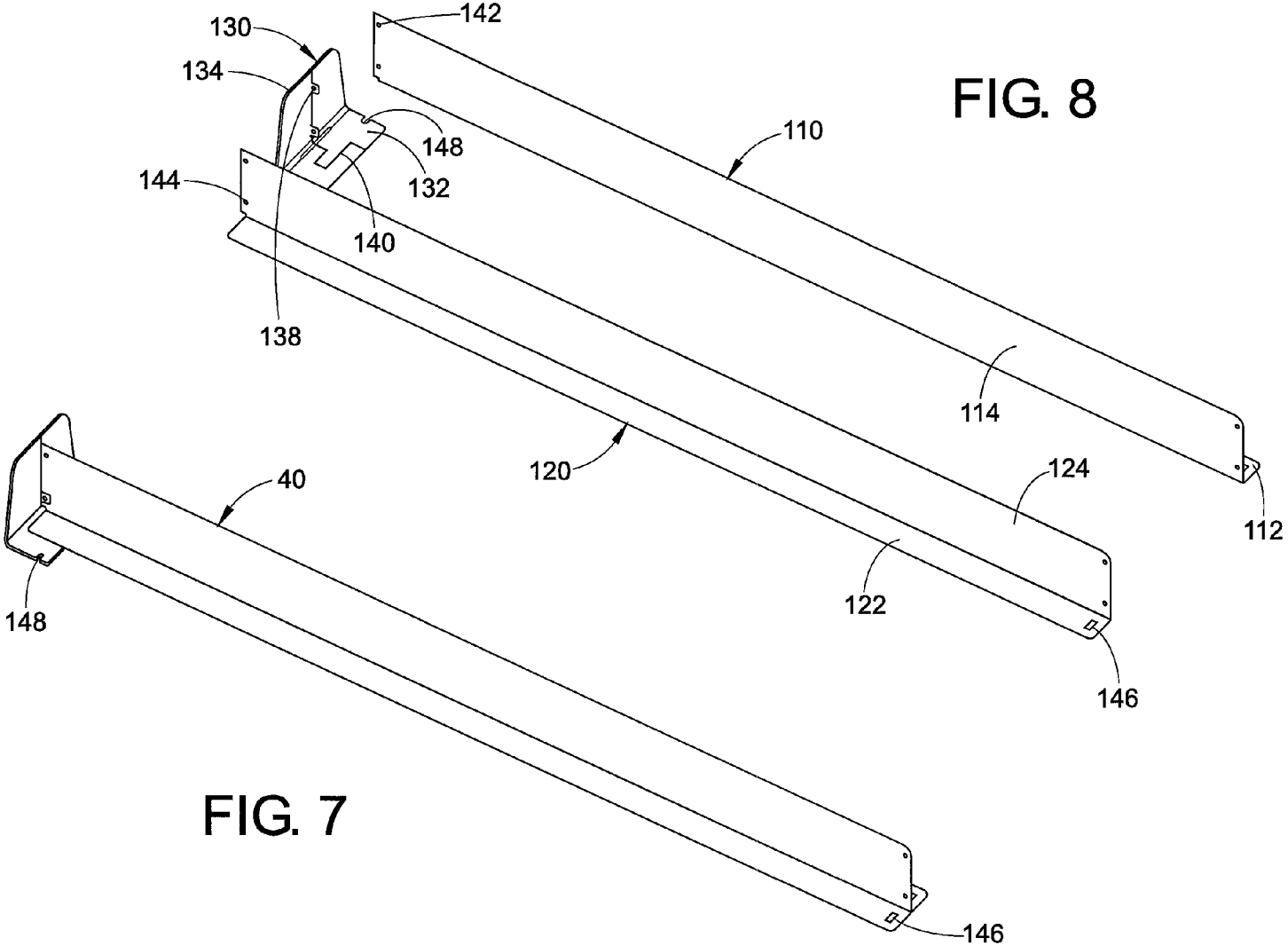
FIG. 7 is an assembled view of a divider assembly of the merchandising system of FIG. 1.
FIG. 8 is an exploded perspective view of the divider assembly of FIG. 7.

With reference now to FIG. 8, in this embodiment, the divider assembly 40 comprises a first L-shaped divider member 110, including a base 112 and an upright wall 114 and a second L-shaped divider member 120, including a base 122 and an upright wall 124. The two divider members 110 and 120 may be secured to a product stop or cap 130. The cap is located at the front end of the shelf and can comprise a base 132 and a front wall 134. Extending rearwardly from the front wall are one or more tabs 138 which are meant to engage with suitable apertures, protrusions or similar connecting elements 142 in the upright wall sections 114 and 124 of the first and second L-shaped dividers 110 and 120. In this way, the two dividers 110 and 120 are secured to the cap 130. This may be accomplished by the use of fasteners (not shown). Alternatively, suitable cooperating locking elements may be provided for the cap 130 and the dividers 110 and 120 so as to connect them to each other. It should also be appreciated from FIG. 8 that the cap 130 can itself be a two part item with the two parts being joined to each other as shown by the dividing line 140 in the base.

With reference now to FIG. 7, defined in a respective base 112, 122 of the respective divider can be a connector element 146 which can connect with the teeth 36 in the rear mount 34 illustrated in FIG. 2. Defined in the base 132 of the cap 130 can be one or more slots 148 through which the connectors 42 can extend.

It should be appreciated that the divider members 110, 120 rest on the base 132 of the cap 130, thereby enlarging the height of the slot 46 defined between bottom surfaces of the divider bases 112, 122 and the top surface of the shelf 10.

Figure 15:
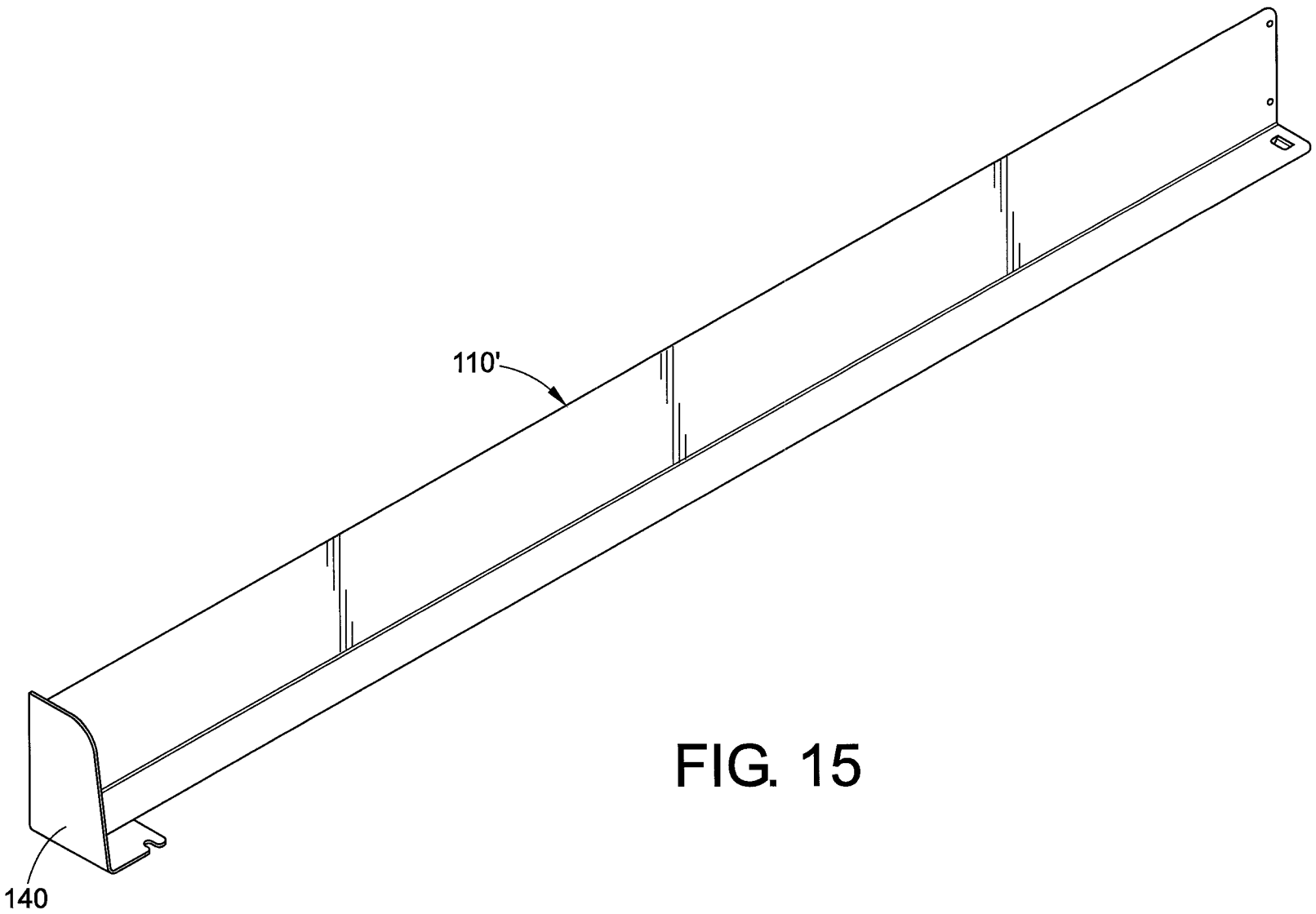
FIG. 15 is a perspective view of an end divider which can be employed with the merchandising system of FIG. 1.

The end of each shelf 10, i.e., laterally to the left end and right end of the shelf, there is an end divider assembly (see FIG. 15). The end divider assembly uses only one L-shaped divider 110' and only half of the front product stop, in the form of stop 140. Of course, the pusher 50 still has two legs 80 which are adapted to travel in the respective slot 46 defined beneath the respective divider (or end divider) and the top surface of the shelf 10. In other words, the thickness of the legs 80 is less than the height of the slot 46.

Figure 9:
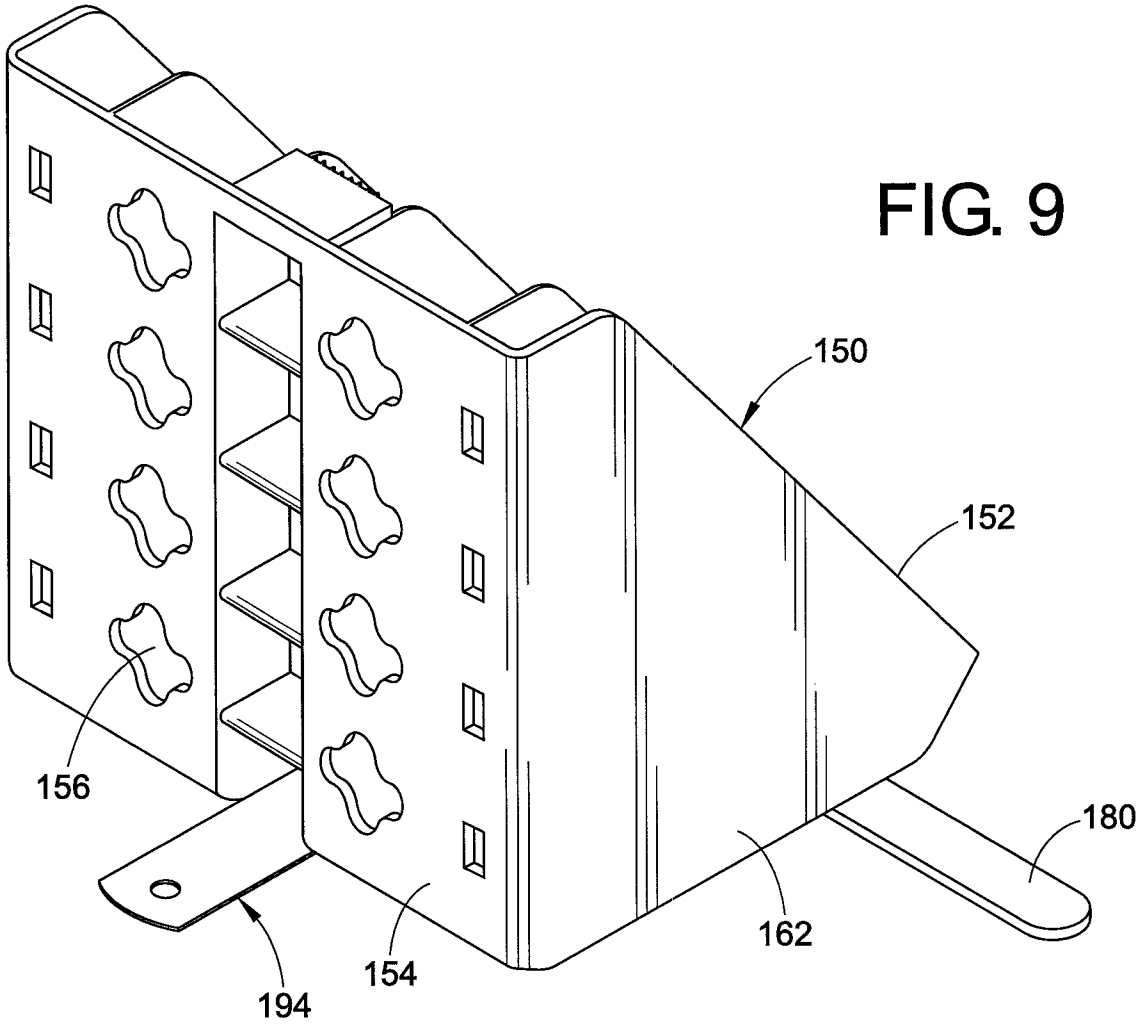
FIG. 9 is an enlarged perspective view of a pusher according to another embodiment of the present disclosure.

Another embodiment of a pusher according to the present disclosure is illustrated in FIG. 9. In this embodiment, a pusher 150 includes a pusher body 152 comprising a pusher face 154. Defined in the pusher face are one or more apertures 156, which may be of different shapes and sizes. One reason that such apertures may be advantageous is to lighten the weight of the pusher, making the pusher lighter and easier to move in relation to the shelf. Extending between the pusher face 154 and a base 160 of the pusher are a set of spaced gussets 162.

Figure 10:
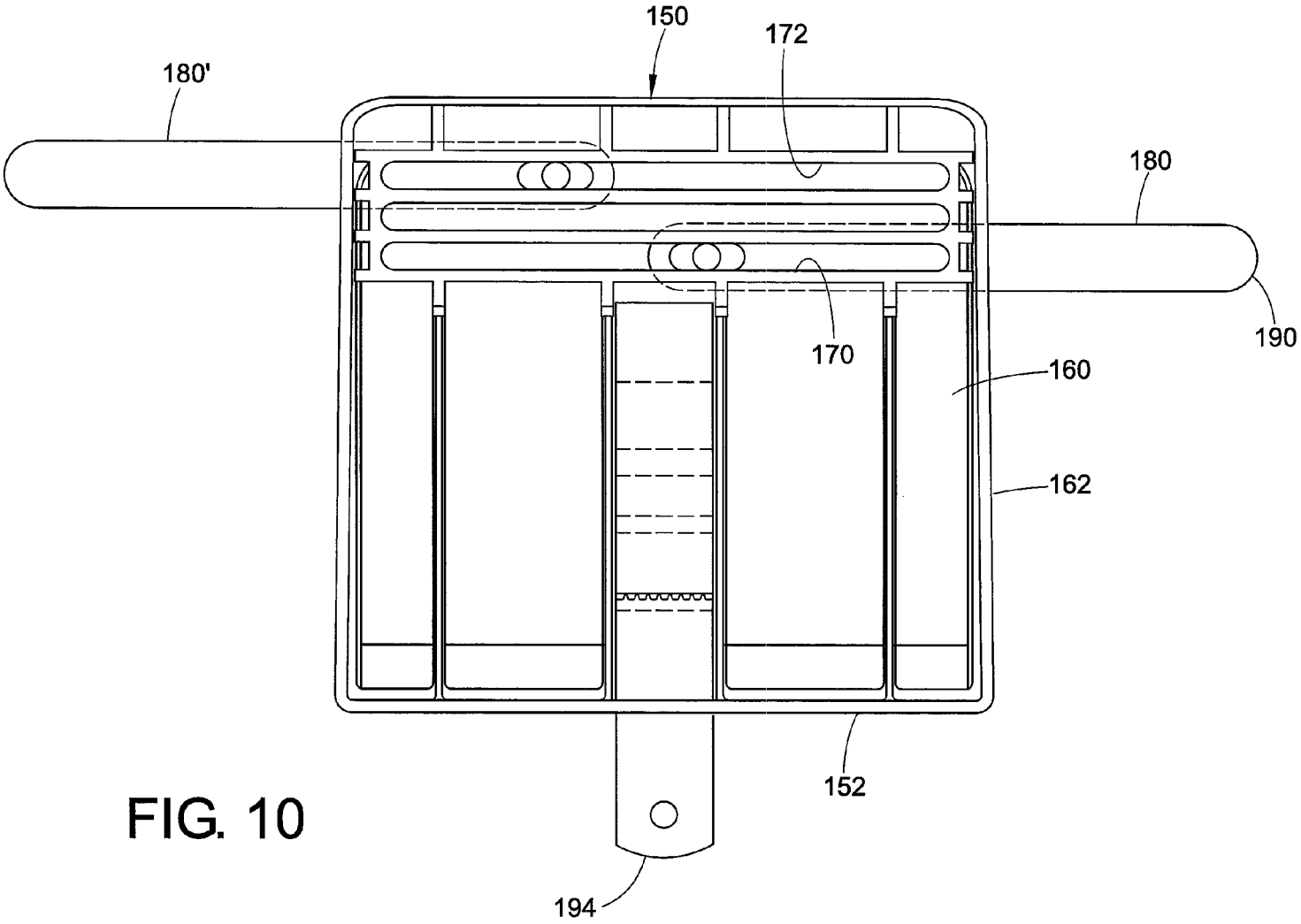
FIG. 10 is a top plan view of the pusher of FIG. 9.
Figure 11:
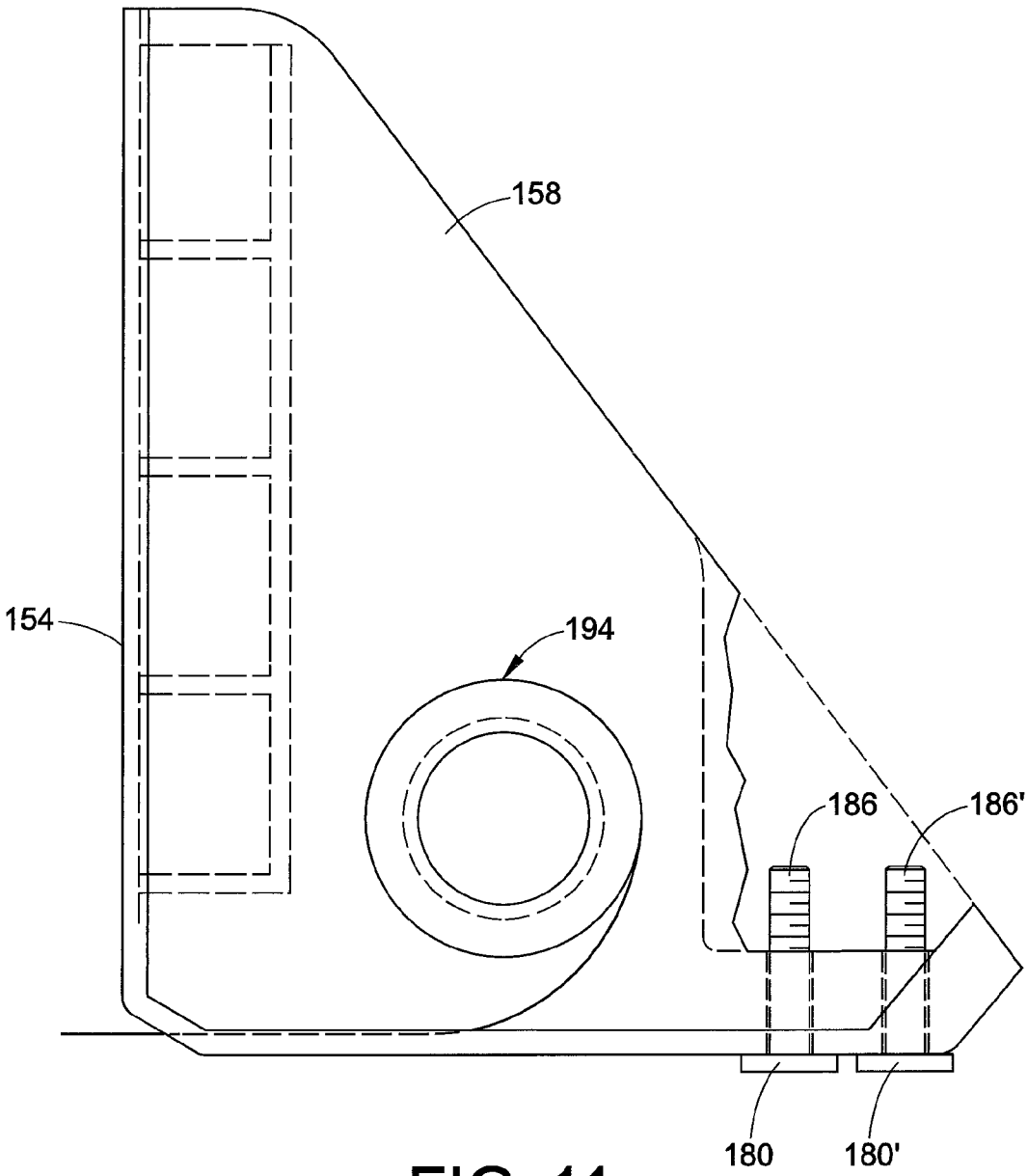
FIG. 11 is a side elevational view, partially broken away, of the pusher of FIG. 10.
Figure 12:
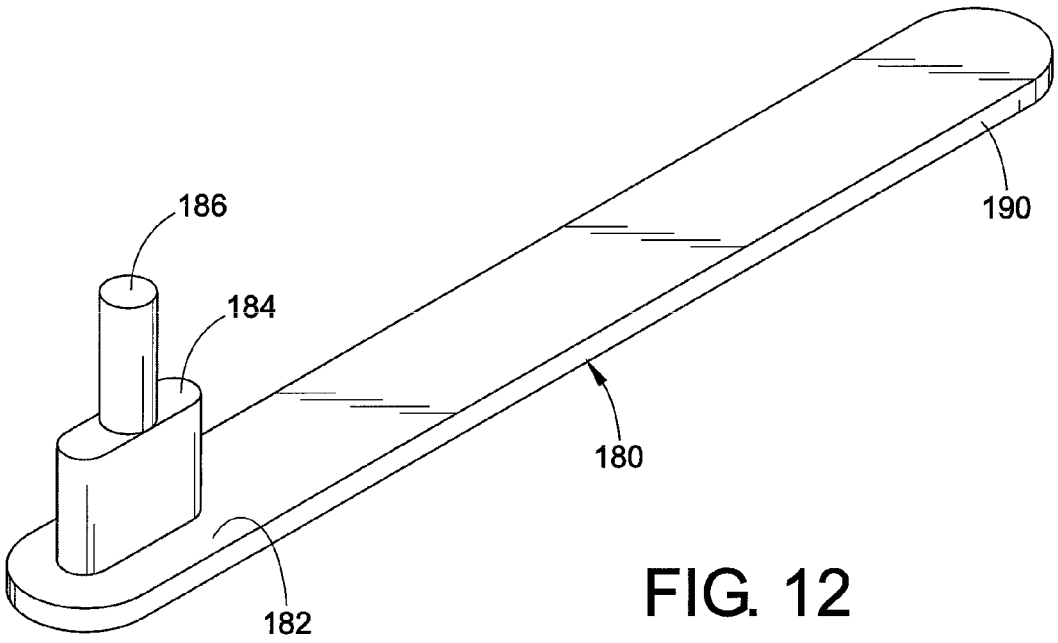
FIG. 12 is an enlarged perspective view of an arm of the pusher of FIG. 11.

With reference now to FIG. 10, defined in the pusher base 160 is a first slot 170 and, spaced therefrom, a second slot 172. The slots extend laterally in the base in this embodiment. Mounted in each slot is a respective arm 180. Since the two arms are identical, except for their orientation, the second arm will be identified with a primed suffix as 180'. It should be appreciated that a discussion of the first arm 180 also applies to the second arm 180'. With reference now to FIG. 12, the arm 180 comprises a first end 182. Defined on the arm first end is a projection 184 which is shaped so as to be accommodated in the slot 170. These cooperating members retard any tendency of the arm 180 to pivot in the slot 170. Extending upwardly from the projection 184 is a grasping element or handle 186. As is evident from FIG. 11, the grasping element 186 is accessible from the top of the pusher body 152 so that the arm 180 can be slid in relation to the pusher 150 laterally, as may be desired from a retracted position to an extended position. Thus, a free end 190 of the arm can be spaced from the pusher 150 by a desired distance so as to be accommodated in a slot defined between a bottom wall or base of a divider and the top wall of a merchandising shelf.

Figure 13:
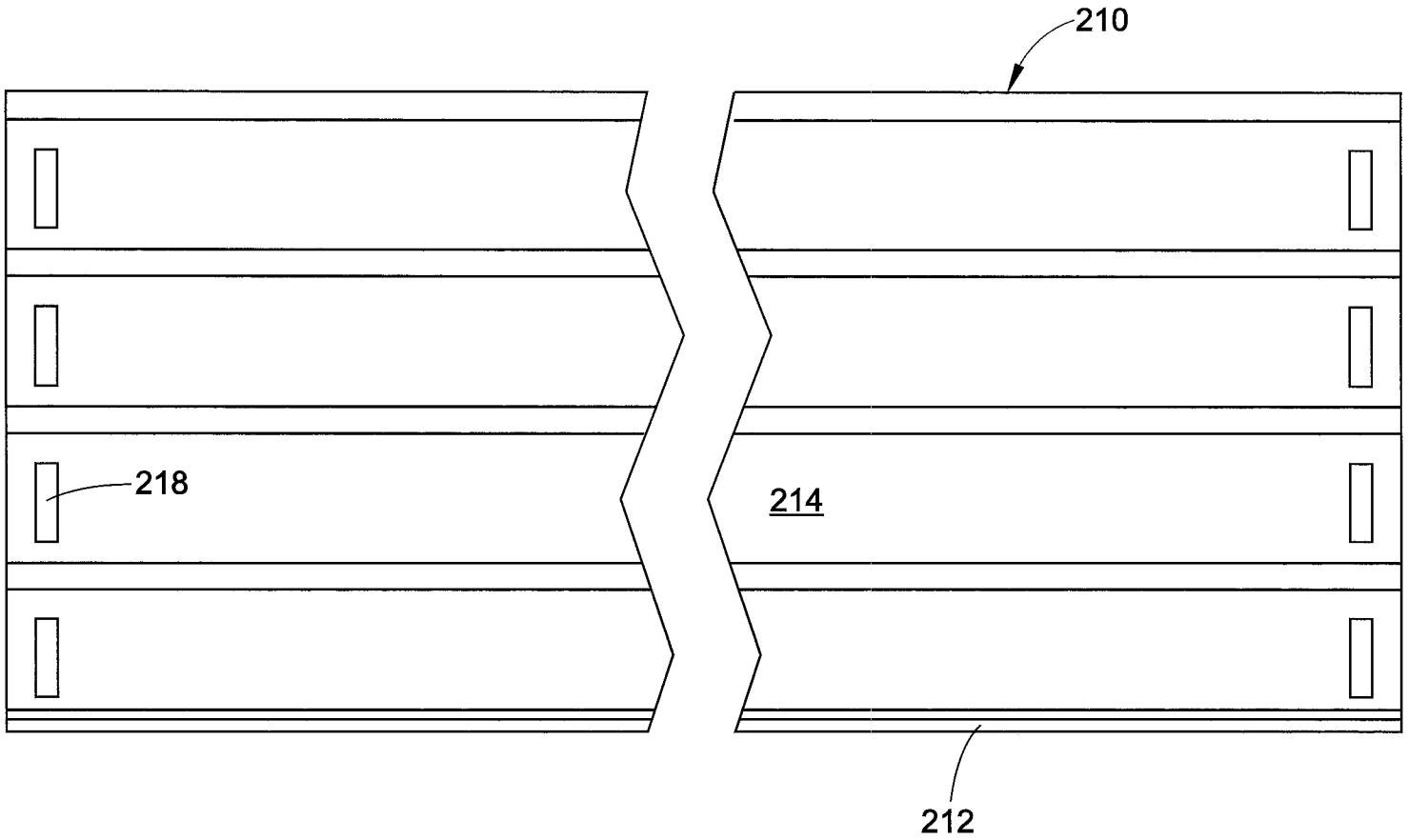
FIG. 13 is a side elevational view, partially broken away, of a divider according to another embodiment of the present disclosure.
Figure 14:
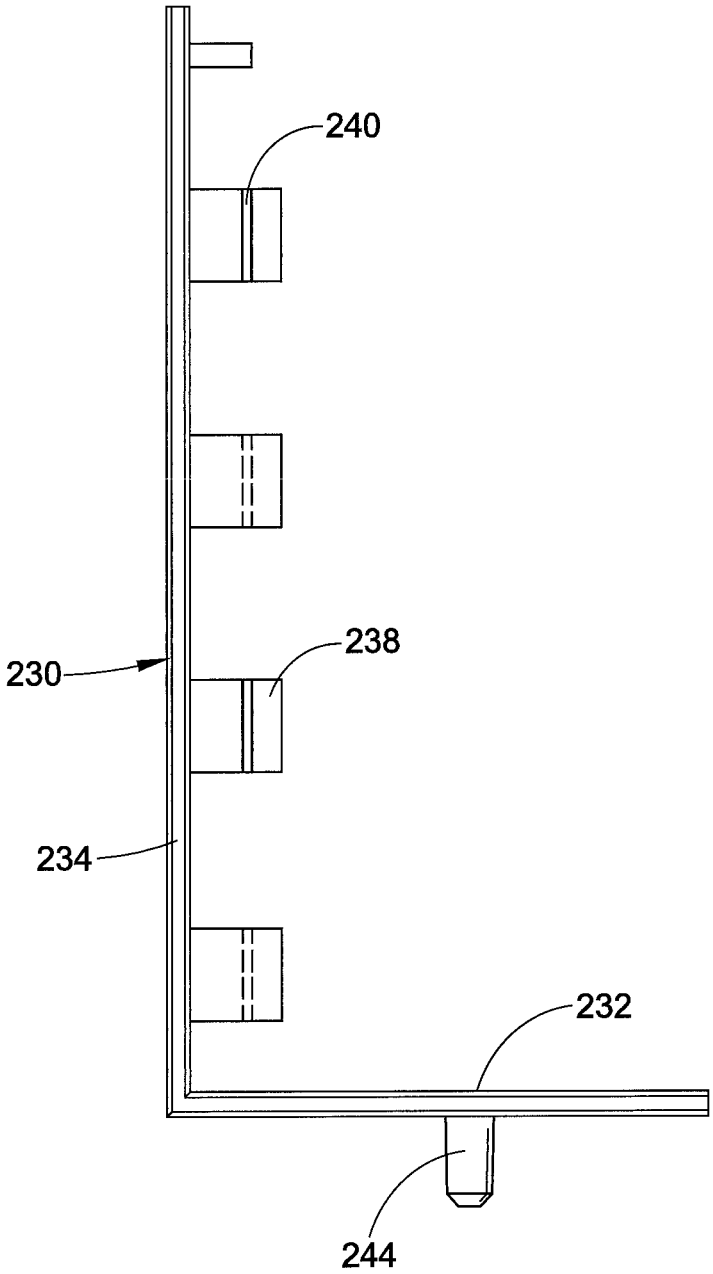
FIG. 14 is a side elevational view of a product stop according to another embodiment of the present disclosure.

With reference now to FIG. 13, another embodiment of a divider 210 includes a base 212 and an upright wall 214. Defined in the upright wall may be one or more apertures 218 that can be vertically spaced. Two such dividers can be provided with each of the dividers being L-shaped if so desired. Alternatively, a single T-shaped divider could be employed instead. In one embodiment, the divider 210 can be mounted to a product stop 230 as illustrated in FIG. 14. The product stop comprises a base 232, upon which rests the divider base 212, and a front wall 234. Extending rearwardly from the front wall may be a plurality of tabs 238 which each include a protrusion 240 which is meant to be accommodated in a respective one of the slots 218. It should be appreciated that the protrusions can be oriented in opposite directions so that some of the protrusions 240 face in a left hand direction and others face in a right hand direction as may be evident from FIG. 14. To this end, the protrusions can be laterally spaced from each other so that they accommodate between them the upright wall 214 of the divider 210 and the protrusions 240 can snap into place in a respective one of the apertures 218. In this embodiment, a pin 244 may extend downwardly from the base 232 of the product stop 230 so as to mount the product stop in a suitably shaped aperture in a front grid (such as the grid 30 illustrated in FIG. 2).

Disclosed has been a trackless pusher system for a shelf which defines a top surface and a pusher which includes a base supported by the shelf top surface, such that no portion of the pusher base extends beneath the shelf top surface. Rather, the pusher is mounted to the shelf only by a first end of a coiled spring. A second end of the coiled spring can be supported by the pusher base. Also mounted to the shelf is a divider which comprises a base wall that is spaced from the shelf top surface so as to define a slot between the shelf top surface and the divider base wall. At least one arm is mounted to the pusher for lateral extension in relation to the pusher so that the arm extends into the slot and rides in the slot as the pusher moves forwards and backwards on the shelf.

In one embodiment, the shelf can comprise a wire shelf including a plurality of rods. It should be appreciated, however, that in other embodiments, the shelf may have a solid surface. The divider, as well as the first end of the coiled spring can be mounted to a front grid or other type of mounting structure that is itself mounted to the shelf. In one embodiment, the divider can include first and second L-shaped members and a front cap to which these members are secured. Alternatively, an integrated T-shaped divider can be employed.

In one embodiment, the arm can be pivotable in relation to the pusher base and can be spring biased to one end position, thereby locking the arm in a particular angular orientation in relation to the pusher. One embodiment of such a locking mechanism includes interengaging gear-like ribs or teeth on the pusher and gear-like ribs or teeth on the arm. In another embodiment, the arm is slidable in relation to the pusher base. If desired, two such arms can be employed, one extending laterally from each side of the base so as to be accommodated in a respective slot of a respective one of two divider assemblies located on either side of the pusher and the column of merchandise which is urged forwardly on the shelf by the pusher.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents therefor.

What is claimed:

1. A trackless pusher system for advancing product supported on an associated shelf, the trackless pusher system comprising:

at least one divider mountable to the associated shelf, the at least one divider delimiting one side of a pathway for associated product supported on the associated shelf; and a trackless pusher assembly for advancing the associated product along the pathway, the trackless pusher assembly comprising a pusher body, a securement member securable to a leading portion of the associated shelf, and a spring extending between and connecting the pusher body to the securement member wherein all of the pusher body, the securement member and the spring are spaced away from the at least one divider;

an adjustable first protrusion extending laterally away from the pusher body, the first protrusion being slideably received in a slot at least partially defined by the at least one divider, the slot having a longitudinal axis extending in a common direction with the pathway;

whereby the pusher body is stabilized by the at least one divider as the pusher body advances along the pathway.

2. The trackless pusher system of claim 1, wherein the first protrusion comprises an elongated arm.

3. The trackless pusher system of claim 2, wherein the elongated arm is movable in relation to the pusher body, and wherein adjusting a position of the arm relative to the pusher body changes a lateral extent of the arm.

4. The trackless pusher system of claim 3, further comprising a lock mechanism for locking the elongated arm in a selected one of a plurality of angular positions in relation to the pusher body.

5. The trackless pusher system of claim 4, wherein the lock mechanism includes a gear shaped protrusion associated with the arm, the gear shaped protrusion being adapted to cooperate with a fixed ribbed socket defined in the pusher body, the gear shaped protrusion being telescopically insertable in the ribbed socket in a plurality of orientations corresponding to different angular positions of the arm, whereby the gear shaped protrusion is movable axially between a locked position at which it is telescopically received within the ribbed socket to an unlocked position at which it is axially spaced from the ribbed socket and is allowed to rotate.

6. The trackless pusher system of claim 5, further comprising a spring for biasing the gear shaped protrusion into the locked position.

7. The trackless pusher system of claim 1, further comprising a second protrusion wherein the first and second protrusions extend laterally from opposed side edges of the pusher body.

8. The trackless pusher system of claim 7 wherein the at least one divider comprises two spaced dividers between which the trackless pusher assembly is located such that the first and second protrusions cooperate with a respective one of the two spaced dividers.

9. A trackless pusher assembly for advancing product along a pathway of an associated shelf, the trackless pusher assembly comprising:

a pusher body including a pusher face extending from a base having a width;

a securement member securable to a leading portion of the associated shelf;

a spring extending between and connecting the pusher body to the securement member;

at least one arm extending laterally from a side edge of the pusher body base and adapted to be received in a slot of an associated divider, the at least one arm lying in a plane parallel to a plane of the pusher body base and being adapted to extend beyond the width of the pusher body base by a desired distance wherein the arm is movable in relation to the pusher body such that the pusher body can be positioned a variable distance from the associated divider so as to maintain a distal end of the at least one arm in the slot of the associated divider.

10. The trackless pusher assembly of claim 9, wherein the at least one arm is rotatably secured to the pusher body, and wherein adjusting a rotational position of the at least one arm relative to the pusher body changes a lateral extent of the at least one arm.

11. The trackless pusher assembly of claim 10, further comprising an angular lock mechanism for locking the at least one arm in a desired one of a plurality of angular positions.

12. The trackless pusher assembly of claim 11, wherein the angular lock mechanism includes a gear shaped protrusion associated with the at least one arm and adapted to cooperate with a fixed ribbed socket defined in the pusher body, the gear shaped protrusion being telescopically insertable in the ribbed socket in a plurality of positions corresponding to different angular positions of the at least one arm, whereby the gear shaped protrusion is movable axially between a rotationally interlocked position at which it is telescopically received within the ribbed socket to a rotatable position at which it is axially spaced from the ribbed socket.

13. The trackless pusher assembly of claim 12, further comprising a spring for biasing the gear shaped protrusion towards the first position.

14. The trackless pusher assembly of claim 9 wherein the at least one arm comprises two spaced arms extending laterally from opposed side edges of the pusher body base.

15. A trackless pusher system comprising:

a front rail;

at least one divider comprising:

a divider wall, a divider floor oriented perpendicular to the divider wall, and an engaging member adapted for engaging the front rail;

a trackless pusher assembly comprising:

a pusher body spaced from the at least one divider, a securement member adapted for engaging the front rail in a spaced relationship to the engaging member of the at least one divider, and a spring extending between the pusher body and the securement member, the spring connecting the pusher body to the securement member; and an elongated first arm extending laterally away from the pusher body, the first arm including a distal portion which is slideably received beneath the divider floor of the at least one divider.

16. The system of claim 15 wherein the first arm is adapted to be movable in relation to the pusher body.

17. The system of claim 16, wherein the first arm is movable in relation to the pusher body to change a lateral extent of the first arm.

18. The system of claim 17 further comprising a lock mechanism for locking the first arm in a desired orientation with respect to the pusher body.

19. The system of claim 15 further comprising an elongated second arm, wherein the first and second arms extend outwardly from opposed side edges of the pusher body.

20. The system of claim 15 wherein the first arm is located in a plane oriented parallel to a plane of the divider floor.

* * * * *